United States Patent [19]

Aoki

[11] 4,384,267

[45] May 17, 1983

[54] THERMOSENSITIVE FUSE

[75] Inventor: Shigeru Aoki, Takatsuki, Japan

[73] Assignee: Murata Manufacturing Co., Ltd., Japan

[21] Appl. No.: 281,227

[22] Filed: Jul. 6, 1981

[30] Foreign Application Priority Data

Jul. 7, 1980 [JP] Japan ..... 55-96141[U]

[51] Int. Cl.[3] ..... H01H 37/76

[52] U.S. Cl. ..... 337/407; 337/408; 337/409

[58] Field of Search ..... 337/409, 408, 407

[56] References Cited

U.S. PATENT DOCUMENTS 4,276,532 6/1981 Aoki ..... 337/407

*Primary Examiner*—Harold Broome

*Attorney, Agent, or Firm*—Ostrolenk, Faber, Gerb & Soffen

[57] ABSTRACT

A thermosensitive fuse includes a cylindrical metallic casing having one end closed and the other end opened. The closed end of the casing is connected with a first conductor that extends outwardly from the casing and the opened end is fittingly mounted with a bushing carrying a second conductor. One end of the second conductor projects into the casing and the other end extends outwardly from the casing. Provided in the casing are an organic substance of solid state from the bottom of the casing to an intermediate level thereof, a contact member of slanted cylinder having a diameter smaller than the inner diameter of the casing, a first spring extending between the organic substance and one end of the contact member in a compressed manner, and a second spring, which is weaker than the first spring, extending between the projected end of the conductor and the other end of the contact member in a compressed manner.

12 Claims, 9 Drawing Figures

THERMOSENSITIVE FUSE

BACKGROUND OF THE INVENTION

The present invention relates to a fuse and, more particularly, to a thermosensitive fuse which breaks its electric path when it is heated above a predetermined temperature.

In the field of electric devices, a thermosensitive fuse is employed for cutting the power when the device is over-heated to prevent the device from being damaged.

An example of prior art thermosensitive fuse is shown in FIGS. 1 and 3 and which includes a metallic cylindrical casing 10 having one end closed and the other end opened. The closed end is fixedly connected to a wire or conductor 11 that extends outwardly from the casing 10. The opened end of the casing 10 is fittingly inserted with a bushing 12 made of non-conductive material and supporting a conductor 14 that extends coaxially outwardly from the casing 10. The end 15 of the conductor 14 positioned inside the casing 10 is rounded for effecting a contact with a bottom of a cap member 17 made of conductive material. Usually, the casing 10 is hermetically sealed by a synthetic resin 13 which is deposited on the bushing 12. An organic substance 16 which melts at a certain temperature is filled in the casing 10 from its bottom to a certain level and a partition wall 19 having a diameter smaller than the inner diameter of the casing 10 is placed on the organic substance 16. A spring 18 is provided around the rounded end portion 15 of the conductor 14 and extends between the bushing 12 and the bottom of the cap member 17 in a compressed manner as shown in FIG. 1. Another spring 20 which is stronger than the spring 18 extends between the partition wall 19 and the bottom of the cap member 17 in a compressed manner as shown in FIG. 1. The cap member 17, as best shown in FIG. 2*a* has an outside face of the bottom wall 17*a* tilted relative to the axis of the cap member 17 to allow tilting of the cap member 17 when pushed against the rounded end 15 of the conductor 14 by the spring 20. Accordingly, the opened side edge of the cap member 17 is urged against the inner wall of the casing 10 to effect an electrical contact therebetween.

In a normal condition, the thermosensitive fuse constitutes an electric path between conductors 11 and 14 through the casing 10 and the cap member 17, as shown in FIG. 1. When the thermosensitive fuse is heated to a predetermined temperature, the organic substance 16 suddenly melts to allow expansion of the spring 20, and accordingly, the spring 18 is expanded to locate the cap member 17 away from the rounded end 15 of the wire 14, resulting in break of the electric path, as shown in FIG. 2*a*.

The above described thermosensitive fuse is disclosed in Japanese Utility Model application laid open to public inspection (Jikkaisho 54-174875) , and according to which, the temperature at which the fuse should break can be set to a desired temperature with high accuracy since the melting point of organic substance is very stable. However, there exists such disadvantages as explained below.

Since the spring 18 is partly accommodated inside the cap member 17, its size, particularly the outer diameter, must be smaller than the inner diameter of the cap member 17. Thus, the inner diameter of the spring 18 becomes relatively small, resulting in a short distance between the rounded end 15 of the conductor 14 and the spring 18. Accordingly, the breakdown voltage between the rounded end 15 and the spring 18 is very low. Therefore, in order to obtain a certain strength of breakdown between the conductors 11 and 14 after the fuse break, the size of the fuse can not be very small.

Furthermore, from a structural point of view, the cap member 17 must have a size large enough to accommodate the spring 18, and its side wall must be thick and strong enough to maintain its shape with respect to the pressure applied thereto against the inner wall of the casing 10.

Moreover, during the manufacturing process, a small size cap member 17 reduces the workability, particularly when inserting the spring 18 into the cap member 17. In addition, the cap member 17 must be properly installed in the casing to locate its opened end facing the bushing 12.

In FIGS. 2*b* and 2*c*, there are shown other types of cap member 17. When the cap member 17 of FIG. 2*b* is employed, it often fails to make a contact between the cap member 17 and the inner wall of the casing 10 because the spring 18, which is arranged to exert the tilting force, is weaker than the spring 20. And, when the cap member 17 of FIG. 2*c* is employed, the opened end edge of the cap member 17 pushes, when the fuse breaks, an intermediate portion of the spring 18 towards the rounded end 15 to reduce the breakdown strength. In fact, none of these cap members of FIGS. 2*b* and 2*c* eliminates the above described disadvantages.

Other prior art themosensitive fuses are disclosed in S. Iwanari's Japanese Utility Model application laid open to public inspection (Jikkaisho 54-181276 and T. Tadokoro's Japanese Utility Model application laid open to public inspection (Jikkaisho 55-111138).

SUMMARY OF THE INVENTION

Accordingly, it is a primary object of the present invention to provide an improved thermosensitive fuse which eliminates above described disadvantages.

It is another object of the present invention to provide a thermosensitive fuse of the above described type which can be formed in a very small size with high breakdown strength.

It is a further object of the present invention to provide a thermosensitive fuse of the above described type which is simple in construction and can readily be manufactured at low cost.

In accomplishing these and other objects, a thermosensitive fuse according to the present invention comprises a casing made of an electrically conductive material. The casing has an elongated configuration with its one end opened and the other end closed. A first conductor is connected to the casing. A meltable substance which is in a solid state under a predetermined temperature and in a liquid state above the certain temperature is provided in the casing in the solid state from the closed end to an intermediate level thereof. A bushing made of an electrically non-conductive material is fixedly attached to the open end of the casing, and a second conductor supported by the bushing is provided in such a manner that one end of the second conductor projects into the casing in alignment with an axis of the elongated casing and the other end of the second conductor extends outwardly from the casing. A contact member made of, or coated with, an electrically conductive material is movably housed in the casing. The contact member has first and second end faces located at opposite ends of the contact member, an angle defined between at least one of the end faces and an axis of the contact member extending between the centers of said first and second faces being other than 90°. The first end face is located adjacent to the meltable substance and the second end face is located adjacent to the bushing. The thermosensitive fuse further comprises a first coil spring housed in the casing between the meltable substance and the first end face of the contact member for pushing the contact member against said one end of the second conductor, and a second coil spring, which is weaker than the first coil spring, is housed in the casing between the bushing and the second end face of the contact member for biasing the contact member away from the one end of the second conductor. The first and second springs act on the contact member to produce a moment about the one end of the second conductor, establishing an electrical path between the first and second conductors through the casing and the contact member. The meltable substance melts above the predetermined temperature to release the first coil spring from pushing the contact member against one end of the second conductor to effect the separation of the contact member away from one end of the second conductor by the biasing force of the second coil spring.

BRIEF DESCRIPTION OF THE DRAWINGS

These and other objects and features of the present invention will become apparent from the following description taken in conjunction with a preferred embodiment thereof with reference to the accompanying drawings, throughout which like parts are designated by like reference numerals, and in which.

DESCRIPTION OF THE PREFERRED EMBODIMENT

Figure 1:
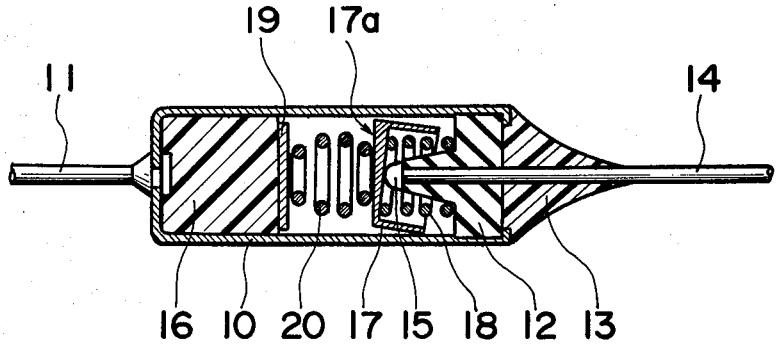
Fig. 1 PRIOR ART
FIGS. 1 and 3 are cross-sectional views of a thermosensitive fuse of prior art, FIG. 1 particularly showing a state in which the fuse is not broken, and FIG. 3 particularly showing a state in which the fuse is broken.
Figure 3:
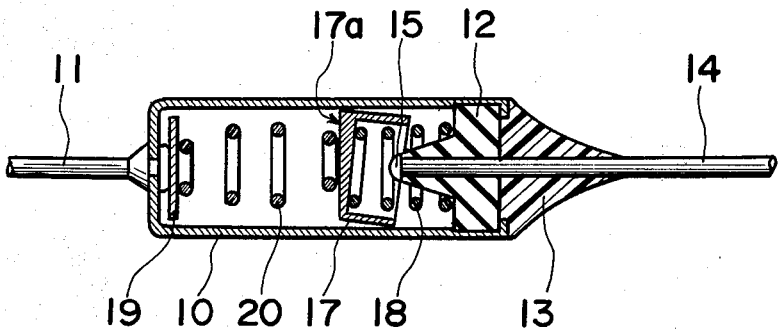
Fig. 3 PRIOR ART
Figure 2A:
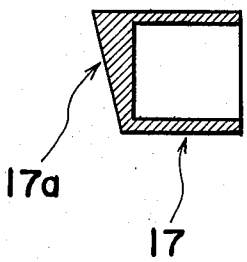
Fig. 2a PRIOR ART
FIGS. 2*a*, 2*b* and 2*c* are cross-sectional views showing various types of a cap member employed in the thermosensitive fuse of prior art.
Figure 2B:
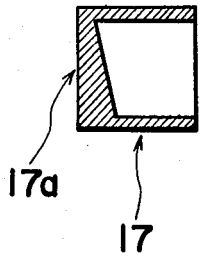
Fig. 2b PRIOR ART
Figure 2C:
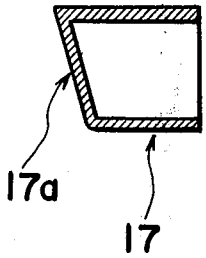
Fig. 2c PRIOR ART
Figure 4:
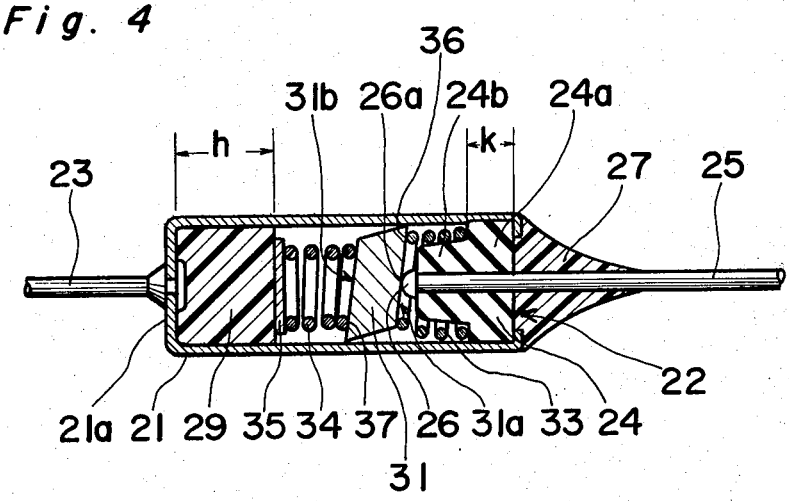
FIG. 4 is a cross-sectional view of a thermosensitive fuse according to the present invention.

Referring to FIG. 4, a thermosensitive fuse of the present invention comprises a casing 21 made of electrically high conductive material, such as brass, by the use of any known press work. The casing 21 has a cylindrical configuration and has one end opened at 22 and the other end closed by a bottom wall 21*a*, said bottom wall 21*a* having a small opening defined therein at the center thereof. One end of an electroconductive lead wire or conductor 23 is received in and staked or rivetted to the bottom wall 21*a* in alignment with the small opening in said wall 21*a* and extends outwardly from the casing 21 in a direction at right angles to the plane of the bottom wall 21*a*.

The open end 22 of the casing 21 is closed by a bushing 24 made of insulating material, such as synthetic resin or ceramics. The bushing 24 includes a first end portion 24*a* formed in the shape of a disc having a diameter which, when the bushing 24 is taken out from the casing 21 is, slightly greater than the inner diameter d (FIG. 6) of the casing 21. The second end portion 24*b* of the bushing 24 is formed in a shape of cone tapered towards a direction opposite to the end portion 24*a* to define a shoulder portion at the rim of the disc portion 24*a*. The bushing 24 has a through hole formed along its axis for receiving an electroconductive lead wire or conductor 25 having one end rounded to define a head portion 26 that locates at the tapered end of the bushing 24 and the other end extending outwardly from the center of the disc portion 24*a* of the bushing 24. When the bushing 24 supporting the conductor 25 is inserted into the casing 21 with the tapered end 24*b* located inside the casing 21, the disc portion 24*a* fittingly engages the inner wall of the casing 21 along its thickness k. After placing the bushing 24 into casing 21, the open end 22 of the casing 21 is bent inwardly to prevent the bushing 24 from being forced out of the casing 21, and a resin, such as an epoxy resin 27, is deposited around the open end 22 to hermetically seal the casing 21.

Provided inside and at the bottom of the casing 21 with a thickness h is an organic substance 29 that melts above a predetermined temperature. A partition wall 35 having a diameter smaller than the inner diameter d of the casing 21 is placed on the solid organic substance 29, and a compressed coil spring 34 having one end touching the partition wall 35 is placed in the casing 21. As understood to those skilled in the art, the partition wall 35 is provided prevent the spring 34 from piercing the organic substance 29. The other end of the spring 34 is touching a contact member 31 which is described in detail below.

Figure 5:
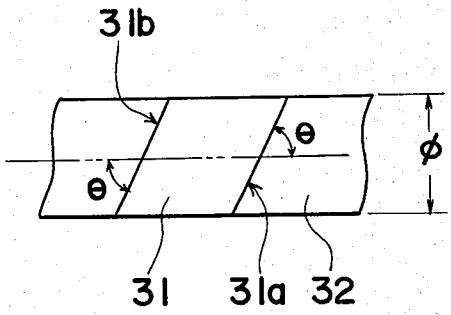
FIG. 5 is a side view of a cylindrical bar showing a manner in which a contact member employed in the thermosensitive fuse of FIG. 4 is obtained.

Referring particularly to FIG. 5, the contact member 31 is cut from a cylindrical bar 32 made of electrically conductive material, such as silver, copper or brass, and having a diameter Φ smaller than the inner diameter d of the casing 21, such that the cut faces 31*a* and 31*b* are parallel to each other and are slanted $\theta°$ ($<90°$) with respect to the axis of the bar 32.

Referring to FIG. 4, the cut face 31*b* of the contact member 31 is held in contact with the end of the compressed spring 34, as mentioned above, and the other cut face 31*a* is held in contact with the head portion 26. Another coil spring 33 having an outer diameter slightly smaller than the inner diameter of the casing 21 is positioned between the cut face 31*a* and the shoulder portion of the bushing 24, in a compressed manner. An intermediate portion of the spring 33 is mounted on the tapered portion 24*a* of the bushing 24. It is to be noted that in the position shown in FIG. 4, the pushing force of the spring 34 acting on the contact member 31 towards right-hand direction is greater than the pushing force of the spring 33 acting on the same towards left-hand direction.

Figure 6:
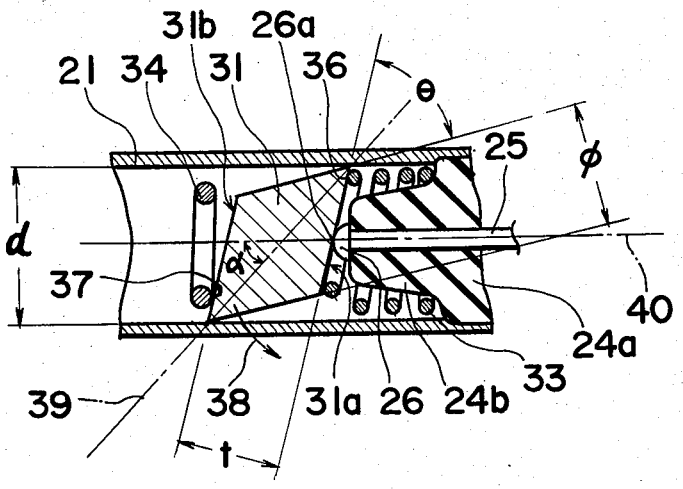
FIG. 6 is a partial view of FIG. 4 in an enlarged scale.

Accordingly, in a normal condition, i.e., when the temperature of the thermosensitive fuse is below the predetermined temperature, the organic substance 29 is held in a solid condition to maintain the contact member 31 in contact with the head portion 26, particularly at a point 26*a*, as best shown in FIG. 6.

In this case, since the contacting face 31*a* of the contact member 31 is slanted, the pushing force of the spring 33 acting on the slanted face 31*a* is maximum at a point 36 where the distance between the slanted face 31*a* and the shoulder portion of the bushing 24 is shortest. Similarly, the pushing force of the spring 34 is maximum at a point 37 where the distance between the slanted face 31*b* and the partition wall 35 is shortest. Accordingly, the contact member 31 receives a moment about the point 26*a*, serving as a fulcrum, in a direction shown by an arrow 38. Thus, the sharp edges of the contact member 31 that contain an acute angle are urged against inner wall of the casing 21 to effect a good electric connection between the contact member 31 and the casing 21.

Figure 7:
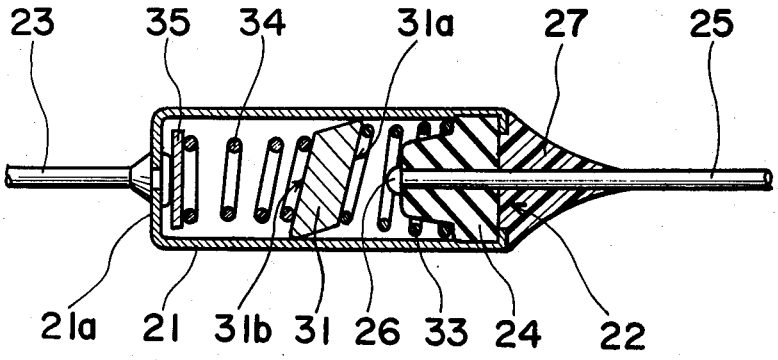
FIG. 7 is a view similar to FIG. 4, but particularly showing a state when the fuse is broken.

In contrast, when the thermosensitive fuse is heated above the predetermined temperature, the organic substance 29 melts, as shown in FIG. 7, to release the spring 33 and 34 from the compressed condition. In this case the pushing force of the spring 33 acting on the contact member 31 located at the position shown in FIG. 6 is greater than the pushing force of the spring 34 acting on the same contact member 31 but in the opposite direction. Accordingly, the contact member 31 separates from the head portion 26 by the pushing force of the spring 33 to electrically disconnect the contact member 31 from the head portion 26, i.e., the conductor 25.

In this case, since the spring 33 has a maximum diameter that can be incorporated in the casing 21, the distance between the spring 33 and the head portion 26 is relatively long to increase the breakdown voltage therebetween, when compared with the conventional thermosensitive fuse.

According to a preferred embodiment, the contact member 31 should be designed in such a size and configuration that an angle $\alpha$ defined between the axis 40 of the casing 21 and a line 39 extending between sharp edges of the contact member should be $\alpha \leqq 45°$ to allow a smooth movement of the contact member 31 away from the head portion 26, preventing the sharp edge from being stuck in the casing 21.

Instead of forming the contact member 31 in a manner described above, it can be so formed that the sharp edges containing an acute angle can be rounded, as shown in FIG. 7, by the method of, e.g., grinding, to effect the smooth movement of the contact member 31.

Furthermore, the diameter $\Phi$ of the contact member 31 should be as large as possible within a range capable of making a free movement inside the casing 21, and the thickness t of the contact member 31 measured between the faces 31*a* and 31*b* should be as small as possible, from the view point of minimizing the size of the thermosensitive fuse.

Moreover, according to a preferred embodiment, the contact member 31 and/or inner surface of the casing 21 can be coated with precious metal, such as gold or silver, to reduce the contact resistance between the contact member 31 and the casing 21 or between the contact member 31 and the head portion 26.

As understood from the foregoing description, since the contact member 31 is formed from a cylindrical bar, it can be manufactured with less steps and less cost when compared with the conventional contact member, such as cap member. Furthermore, since the contact member has a symmetric shape about its center, the thermosensitive fuse of the present invention can be manufactured with simple steps. Moreover, since the space between the spring 33 and the head portion 26 obtained after the fuse break is considerable, it is possible to prepare a thermosensitive fuse which is relative compact in size for any rated breakdown voltage.

It is to be noted that, in order to effect a contact during the normal condition between the contact member 31 and the inner face of the casing 21, it is not necessary to have both faces 31*a* and 31*b* slanted with respect to the axis of the bar 32. For example, it is possible to have one face slanted and the other face provided perpendicularly to the axis of the bar 32.

Furthermore, even when both faces 31*a* and 31*b* slanted, they can be slanted in different angles.

Moreover, the cross-section of the contact member can be other than circle, for example, oval or polygone so long as the cross-section has a size that can be accommodated in a casing.

Although the present invention has been fully described with reference to a preferred embodiment, many modifications and variations thereof will now be apparent to those skilled in the art, and the scope of the present invention is therefore to be limited not by the details of the preferred embodiment described above, but only by the terms of the appended claims.

What is claimed is:

1. A thermosensitive fuse, comprising:

a casing made of an electrically conductive material, said casing having an axially elongated configuration with its one end opened and the other end closed;

a first conductor connected to said casing;

a meltable substance located in said casing and extending from said closed end of said casing to a position between said closed and opened ends, said meltable substance being in a solid state when it is under a predetermined temperature and in a liquid state when it is above said predetermined temperature;

a bushing made of an electrically non-conductive material and fixedly attached to said open end of said casing;

a second conductor supported by said bushing such that one end of said second conductor projects into said casing in alignment with an axis of said elongated casing and the other end of said second conductor extends outwardly from said casing;

a solid contact member made of, or coated with, an electrically conductive material and having first and second end faces located at opposite ends of said contact member, said end faces being parallel to one another, an angle defined between said end faces and an axis of said contact member extending between the centers of said first and second end faces being other than 90°, said contact member being movably housed in said casing with said first end face facing said meltable substance and said second end face facing said bushing;

a first coil spring housed in said casing between said meltable substance and said first end face of the contact member for pushing said contact member against said one end of said second conductor; and a second coil spring, which is weaker than said first coil spring, housed in said casing between said bushing and said second end face of said contact member for biasing said contact member away from said one end of said second conductor, said first and second springs acting on said contact member to produce a moment about said one end of said second conductor such that said contact member contacts said casing and establishes an electrical path between said first and second conductors through said casing and said contact member, said meltable substance being melted above said predetermined temperature to release said first coil spring from pushing said contact member against said one end of said second conductor to effect the separation of said contact member away from said one end of said second conductor by the biasing force of the second coil spring.

2. A thermosensitive fuse as claimed in claim 1, wherein said meltable substance is an organic substance.

3. A thermosensitive fuse as claimed in claim 1, further comprising a partition wall positioned between said meltable substance and said first coil spring.

4. A thermosensitive fuse as claimed in claim 1, wherein said second coil spring has an outer diameter of maximum size within a range capable of insertion of said second coil spring into said casing.

5. A thermosensitive fuse as claimed in claim 1, further comprising a hermetically sealing material deposited on said bushing for hermetically sealing said casing.

6. A thermosensitive fuse as claimed in claim 1, wherein said casing has a cylindrical configuration.

7. A thermosensitive fuse as claimed in claim 6, wherein said contact member is generally cylindrical in shape.

8. A thermosensitive fuse as claimed in claim 7, wherein an angle defined between an axis of said cylindrical casing and a line extending between acute angled edges of said contact member is smaller than 45°.

9. A thermosensitive fuse as claimed in claim 1, wherein said one end of said second conductor is rounded.

10. A thermosensitive fuse as claimed in claim 1, wherein said edges of said contact member which contact said casing are rounded.

11. A thermosensitive fuse as claimed in claim 1, wherein said contact member is generally in the shape of a column.

12. A thermosensitive fuse as claimed in claim 11, wherein said contact member has at least one side surface extending between said end faces, said at least one side surface being parallel to said contact member axis.

* * * * *